US012422228B2

(12) United States Patent
Hong

(10) Patent No.: US 12,422,228 B2
(45) Date of Patent: Sep. 23, 2025

(54) MONITOR DEVICE HAVING BULLET DISPERSION PREVENTION FUNCTION FOR SHOOTING GAME

(71) Applicant: GUNPOWER CORPORATION, Jeollabuk-do (KR)

(72) Inventor: Young Pyo Hong, Jeollabuk-do (KR)

(73) Assignee: GUNPOWER CORPORATION, Jeollabuk-Do (KR)

( * ) Notice: Subject to any disclaimer, the term of this patent is extended or adjusted under 35 U.S.C. 154(b) by 532 days.

(21) Appl. No.: 17/782,247

(22) PCT Filed: Sep. 3, 2020

(86) PCT No.: PCT/KR2020/011883
§ 371 (c)(1),
(2) Date: Jun. 3, 2022

(87) PCT Pub. No.: WO2021/112378
PCT Pub. Date: Jun. 10, 2021

(65) Prior Publication Data

US 2023/0014386 A1 Jan. 19, 2023

(30) Foreign Application Priority Data

Dec. 5, 2019 (KR) ..... 10-2019-0160540

(51) Int. Cl.
*F41J 5/04* (2006.01)
*A63F 9/02* (2006.01)
(Continued)

(52) U.S. Cl.
CPC ..... *F41J 5/14* (2013.01); *A63F 9/02* (2013.01); *F41J 1/01* (2013.01); *F41J 13/02* (2013.01)

(58) Field of Classification Search
None
See application file for complete search history.

(56) References Cited

U.S. PATENT DOCUMENTS 5,516,113 A * 5/1996 Hodge ..... F41J 5/041 178/18.05
6,367,800 B1 * 4/2002 Sheck ..... F41J 5/056 273/371
(Continued)

FOREIGN PATENT DOCUMENTS

JP 2006-336986 A 12/2006
JP 2019-158335 A 9/2019
(Continued)

OTHER PUBLICATIONS

International Search Report for PCT/KR2020/011883 mailed on Dec. 1, 2020.

*Primary Examiner* — Sunit Pandya
(74) *Attorney, Agent, or Firm* — The PL Law Group, PLLC

(57) ABSTRACT

A monitor device according to an embodiment of the present disclosure has a bullet dispersion prevention function for a shooting game. The monitor device includes a frame coupled along a circumferential surface of the display apparatus and protruding out of a front surface of the display device, an impact-absorbing shooting pad coupled to an end of the protruding frame, formed to be transparent to show an image displayed on the display device, and configured to, when a bullet hits a hitting surface at an angle within a preset angle range from the vertical, absorb impact of the bullet so that the bullet hitting the hitting surface falls downward, and a bullet dispersion prevention unit configured to, when a bullet hits the impact-absorbing shooting pad at an angle exceeding the preset angle range from the vertical, enable the bullet to fall downward without being scattered outward.

5 Claims, 6 Drawing Sheets

(51) Int. Cl.

| | |
|---|---|
| ***F41J 1/01*** | (2006.01) |
| ***F41J 5/14*** | (2006.01) |
| ***F41J 13/02*** | (2009.01) |

(56) References Cited

U.S. PATENT DOCUMENTS

| | | | | |
|---|---|---|---|---|
| 6,526,861 | B1 * | 3/2003 | Gruber | F41J 13/00 89/911 |
| 7,966,923 | B2 * | 6/2011 | Daniels | F41H 5/0442 89/917 |
| 8,608,170 | B2 * | 12/2013 | Ball | F41J 1/10 273/407 |
| 8,714,554 | B2 * | 5/2014 | Chu | F41J 3/0028 273/404 |
| 8,931,781 | B2 * | 1/2015 | Dreiband | F41J 13/02 273/404 |
| 2003/0134700 | A1 * | 7/2003 | Salva | F41J 13/02 473/476 |
| 2011/0062667 | A1 * | 3/2011 | Medina | F41J 13/00 273/404 |
| 2016/0138895 | A1 * | 5/2016 | Beine | F41J 5/10 434/19 |

FOREIGN PATENT DOCUMENTS

| | | | |
|---|---|---|---|
| KR | 10-2013-0104700 | A | 9/2013 |
| KR | 10-1851370 | B1 | 4/2018 |
| KR | 10-1968011 | B1 | 4/2019 |
| KR | 10-2148526 | B1 | 8/2020 |

* cited by examiner

MONITOR DEVICE HAVING BULLET DISPERSION PREVENTION FUNCTION FOR SHOOTING GAME

CROSS REFERENCE TO RELATED APPLICATIONS AND CLAIM OF PRIORITY

This application claims benefit under 35 U.S.C. 119, 120, 121, or 365(c), and is a National Stage entry from International Application No. PCT/KR2020/011883 filed on Sep. 3, 2020, which claims priority to the benefit of Korean Patent Application No. 10-2019-0160540 filed in the Korean Intellectual Property Office on Dec. 5, 2019, the entire contents of which are incorporated herein by reference.

BACKGROUND

1. Technical Field

The present disclosure relates to a monitor device having a bullet dispersion prevention function for a shooting game, and more particularly, to a monitor device having a bullet dispersion prevention function for a shooting game in which bullets are gathered to one side without being scattered around a shooting range.

2. Background Art

As the five-day work week has been settled, interest in leisure activities has increased and interest in various leisure activities has increased. Among them, interest in survival games or indoor shooting games using mock guns has increased.

While survival games may allow users to enjoy more exciting leisure activities, the survival games are difficult to access because there are location restrictions and a lot of necessary equipment is required. However, because indoor shooting games do not require equipment other than many mock guns and targets, the indoor shooting games may be seen as one of leisure activities that may be enjoyed more easily than the survival games.

When indoor shooting games are played, commonly known BB bullets are used. Because BB bullets have a good repulsive force, users may feel a hitting sense when the BB bullets hit targets in indoor shooting games. However, because bounced positions of the BB bullets are not constant, a shooting range becomes messy, and even when the BB bullets are recovered by using vacuum cleaners, it is difficult to reuse the BB bullets and thus BB bullets should be constantly purchased, which is disadvantageous in terms of maintenance.

SUMMARY

To solve the problems, there is provided a monitor device having a bullet dispersion prevention function for a shooting game in which bullets are gathered to a side without being scattered around a shooting range.

Objectives of the present disclosure are not limited thereto, and other unmentioned objectives will be clearly understood by one of ordinary skill in the art to which the present disclosure pertains from the following description.

According to an embodiment of the present disclosure, a monitor device having a bullet dispersion prevention function for a shooting game is coupled to a display device and includes a frame coupled along a circumferential surface of the display apparatus and protruding out of a front surface of the display device; an impact-absorbing shooting pad coupled to an end of the protruding frame, formed to be transparent to show an image displayed on the display device, and configured to, when a bullet hits a hitting surface at an angle within a preset angle range from the vertical, absorb impact of the bullet so that the bullet hitting the hitting surface falls downward; and a bullet dispersion prevention unit configured to, when a bullet hits the impact-absorbing shooting pad at an angle exceeding the preset angle range from the vertical, enable the bullet to fall downward without being scattered outward.

The monitor device may further include: a case coupled to a rear end of the frame and protecting a controller located on a rear surface of the display device; and a protective transparent pad being in close contact with a circumferential surface of the frame and a surface of the display device to form a space between the protective transparent pad and the impact-absorbing shooting pad, and configured to, when the impact-absorbing shooting pad is torn and the bullet goes through the impact-absorbing shooting pad, protect the display device.

The bullet dispersion prevention unit may be coupled to each of both side surfaces of the frame or the case and may protrude forward beyond a surface of the impact-absorbing shooting pad to surround the impact-absorbing shooting pad.

The bullet dispersion prevention unit may include a magnet on a side surface and may be attached to both side surfaces of the frame or the case.

The controller may be configured to wirelessly communicate with a mock gun that fires a bullet, and collect, record, and rank data of at least one of a number of fired bullets, a hit rate of a part where a bullet hits the impact-absorbing shooting pad, and a user's response to a firing signal.

In a monitor device having a bullet dispersion prevention function for a shooting game according to the present disclosure, because bullets may be gathered to a side without being scattered around a shooting range, the bullets may be reused and the shooting range may be used cleanly.

Effects of the present disclosure are not limited thereto, and other unmentioned technical effects will be apparent to one of ordinary skill in the art from the following description.

DETAILED DESCRIPTION

Figure 1:
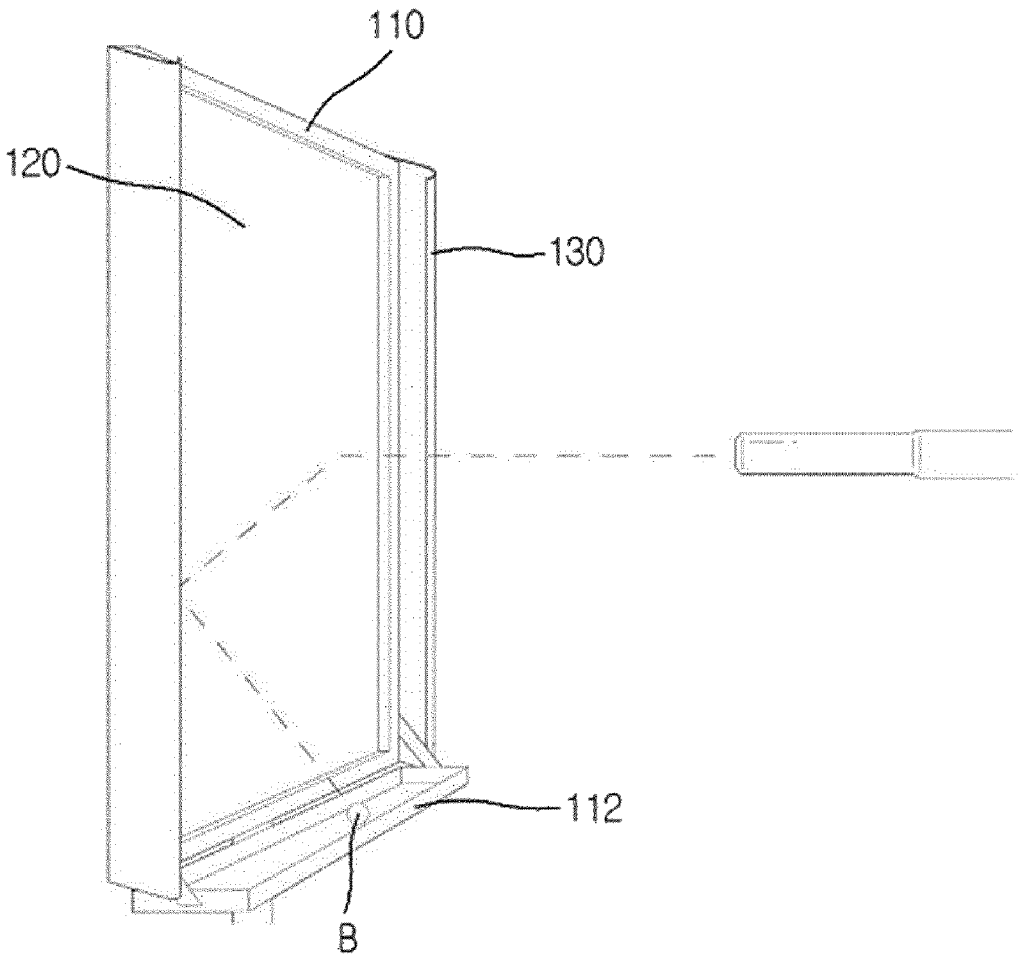
FIG. 1 is a perspective view illustrating a monitor device having a bullet dispersion prevention function for a shooting game according to an embodiment of the present disclosure.

Hereinafter, preferred embodiments of the present disclosure will be described in detail with reference to the accompanying drawings. In the drawings, the same elements are denoted by the same reference numerals. Also, detailed descriptions of related well-known functions or configurations that may blur the points of the present disclosure are omitted. For the same reason, some elements in the accompanying drawings are exaggerated, omitted, or schematically illustrated.

Also, it will be understood that when a certain part "includes" a certain component, the part does not exclude another component but may further include another component, unless the context clearly dictates otherwise. Also, throughout the specification, "on" refers to the top or bottom of a target, and does not necessarily mean the top of the target based on a direction of gravity.

Figure 2:
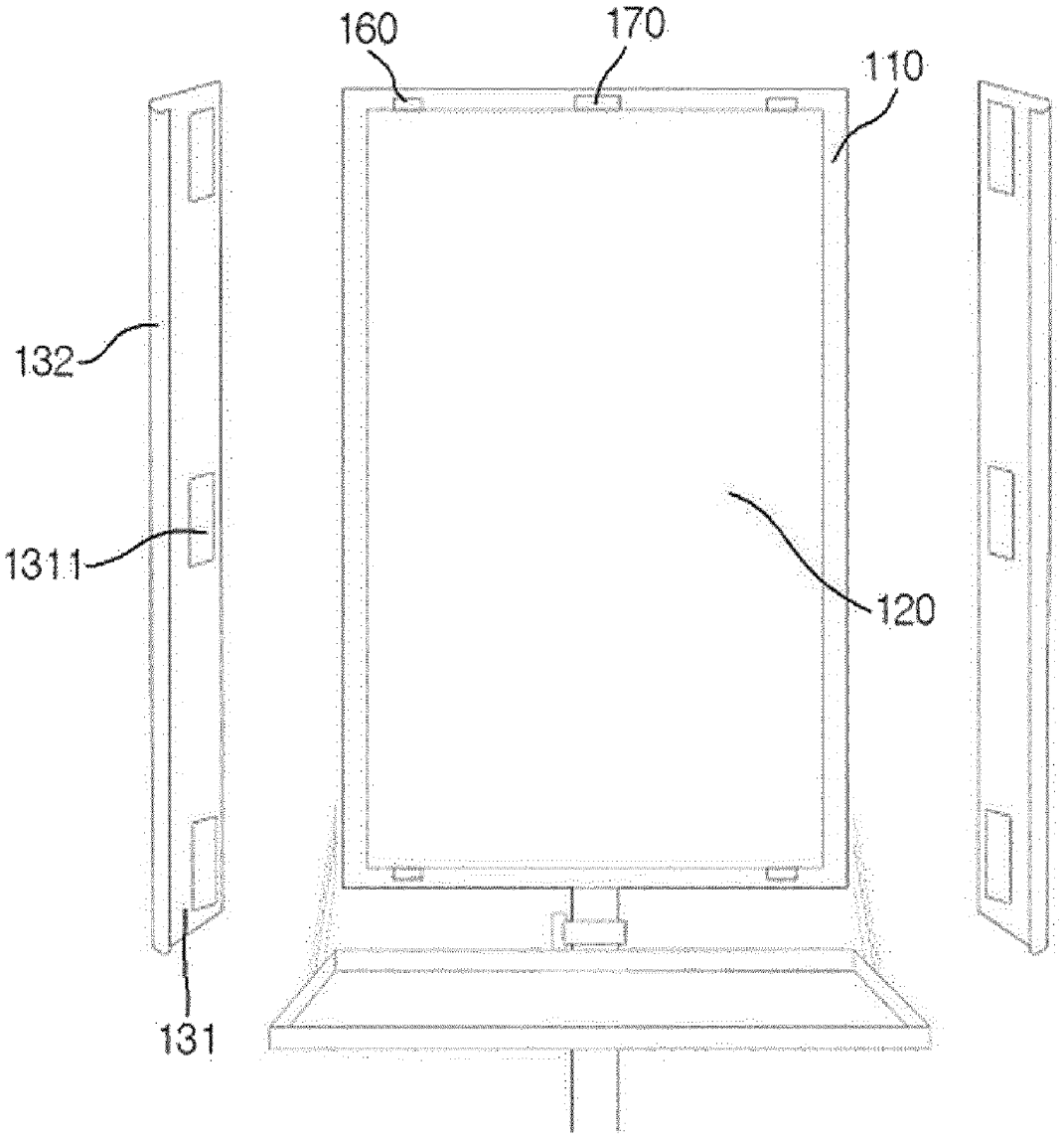
FIG. 2 is an exploded perspective view illustrating a monitor device having a bullet dispersion prevention function for a shooting game according to an embodiment of the present disclosure.
Figure 3:
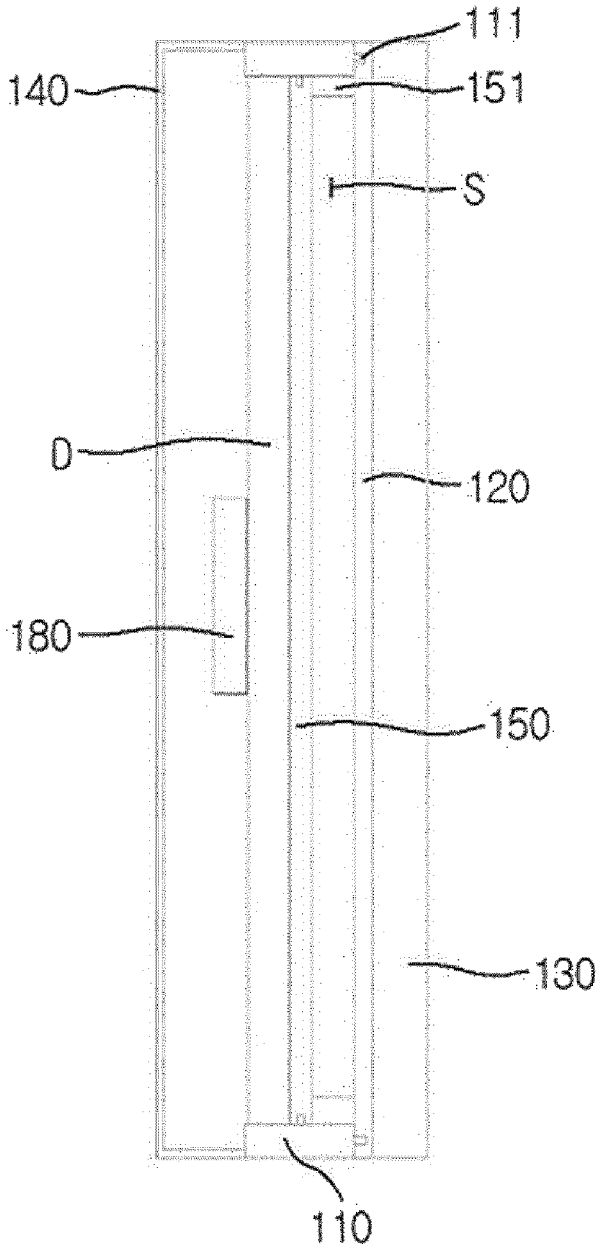
FIG. 3 is a cross-sectional view illustrating a monitor device having a bullet dispersion prevention function for a shooting game according to an embodiment of the present disclosure.
Figure 4:
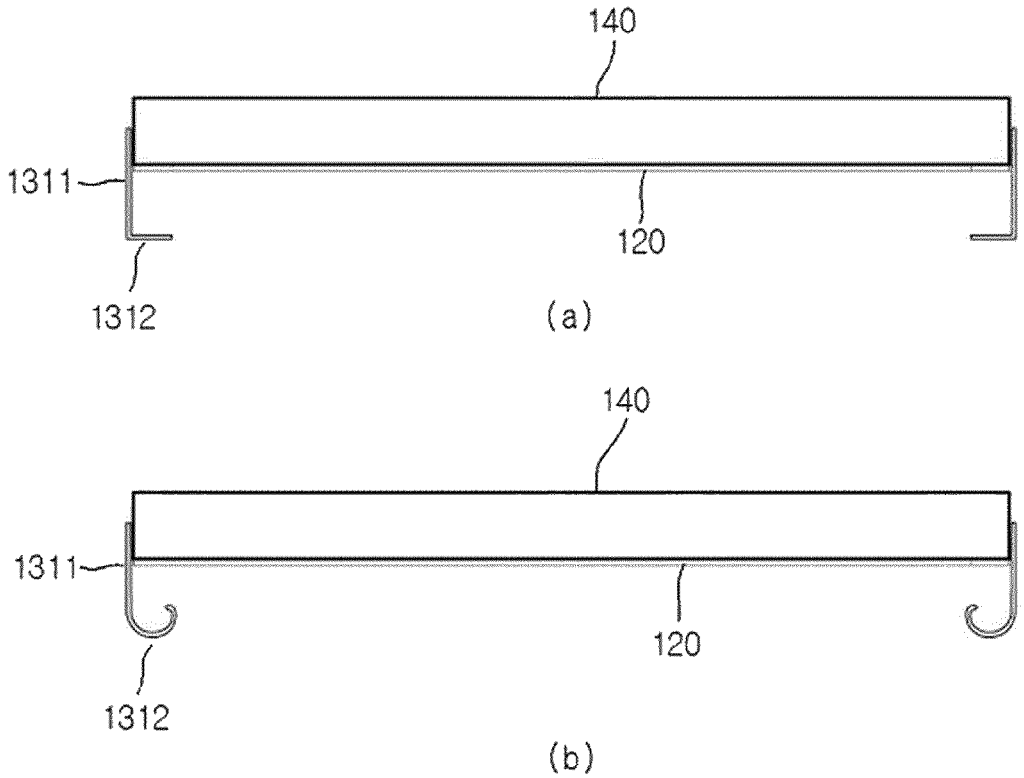
FIG. 4 is a plan view illustrating a monitor device for a shooting game.
Figure 5:
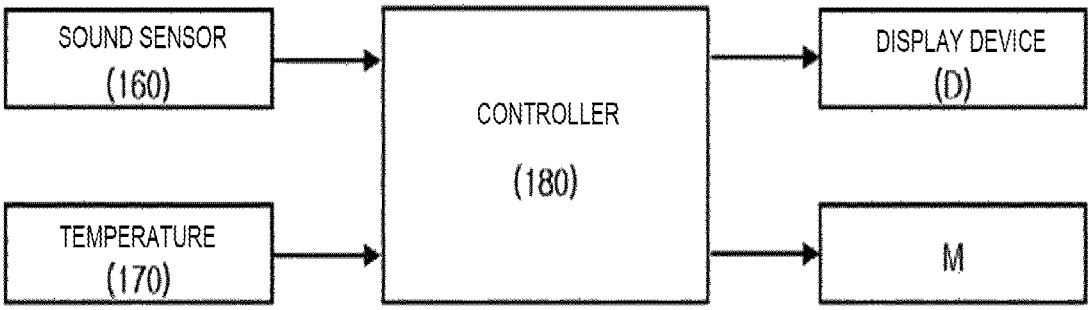
FIG. 5 is a block diagram illustrating a monitor device having a bullet dispersion prevention function for a shooting game according to an embodiment of the present disclosure.

FIG. 1 is a perspective view illustrating a monitor device having a bullet dispersion prevention function for a shooting game according to an embodiment of the present disclosure. FIG. 2 is a cross-sectional view illustrating a monitor device having a bullet dispersion prevention function for a shooting game according to an embodiment of the present disclosure. FIG. 3 is a plan view illustrating a monitor device for a shooting game. FIG. 4 is a conceptual view illustrating hitting of a monitor device having a bullet dispersion prevention function for a shooting game according to an embodiment of the present disclosure. FIG. 5 is a block diagram illustrating a monitor device having a bullet dispersion prevention function for a shooting game according to an embodiment of the present disclosure.

Referring to FIGS. 1 through 5, a monitor device 10 having a bullet dispersion prevention function for a shooting game according to an embodiment of the present disclosure includes a frame 110, an impact-absorbing shooting pad 120, a bullet dispersion prevention unit 130, a case 140, a protective transparent pad 150, a sound sensor 160, a temperature sensor 170, and a controller 180.

The frame 110 forms an inner surface along an inner surface to be coupled to a circumferential surface of a display device D, and is coupled to protrude out of a front surface of the display device D. The frame 110 is formed to correspond to a shape of the display device D, and is closely coupled to a side surface of the display device D and the impact-absorbing shooting pad 120 to form an enclosed space S therebetween. A protrusion 111 may be formed on a portion of a front surface of the frame 110 contacting the impact-absorbing shooting pad 120. The protrusion 111 is closely fitted into the impact-absorbing shooting pad 120 through a sealing material to provide firm coupling and prevent the enclosed space from communicating with the outside.

The display device D coupled to an inner circumferential surface of the frame 110 may be a general liquid-crystal display (LCD), light-emitting diode (LED), or plasma display panel (PDP). Accordingly, the frame 110 may form, but is not limited to, a quadrangular receiving space to correspond to the display device D. Also, a plurality of sound sensors 160 and at least one temperature sensor 170 may be coupled along the inner circumferential surface of the frame 110.

The impact-absorbing shooting pad 120 is formed to be transparent to show an image displayed on the display device D, and is coupled to the protruding frame 110 to function as a shooting panel directly hit by a bullet. When a bullet hits a hitting surface of the impact-absorbing shooting pad 120 at an angle within a preset angle range from the vertical, the impact-absorbing shooting pad 120 absorbs impact of the bullet so that the bullet hitting the hitting surface falls downward without being scattered. Because the bullet is prevented from being bounced to hit people around or scattered in all directions, a clean shooting environment may be provided. The bullet falling downward is collected by a tray 112 coupled to a lower portion of the frame 110. For proper impact absorption of a bullet, the impact-absorbing shooting pad 120 may be formed of, but is not limited to, soft polyvinyl chloride.

In this case, in order to determine an appropriate thickness of the impact-absorbing shooting pad 120, repulsive force, durability, and sensing precision tests were performed for thicknesses of 2, 3, 4, and 5 mm. The repulsive force test was evaluated by the number of bullets accommodated in the tray after 1000 bullets were fired, and the durability test was evaluated by a degree of damage to a surface of the impact-absorbing shooting pad 120 observed with the eyes according to hitting. The sensing precision test was evaluated by a degree of error occurring in a state where a center point of the impact-absorbing shooting pad was hit at a short distance (distance at which a hit position may be checked).

In the impact-absorbing shooting pad having the thickness of 2 mm, 995 bullets were accommodated in the try, and thus, most of the bullets were accommodated. This seems to be due to a small thickness and a small repulsive force. Sound may be transmitted loud and fast due to a small thickness, and thus, it was found that sensing precision through a sound sensor is excellent. However, bullet marks were produced on the surface, and thus, it was found that durability is weak, damage is expected during continuous usage, and frequency replacement is necessary.

In the impact-absorbing shooting pad having the thickness of 3 mm, 990 bullets were accommodated in the try, and thus, most of the bullets were accommodated. No bullet marks remained on the surface, thus, it was found that durability is excellent and long-term use is possible. In addition, almost no error occurred in sensing precision.

In the impact-absorbing shooting pad having the thickness of 4 mm, 975 bullets were accommodated in the try and most of the bullets were accommodated, but less than in the impact-absorbing shooting pad having the thickness of 3 mm. Also, no bullet marks remained on the surface, like in the impact-absorbing shooting pad having the thickness of 3 mm. As a thickness increased, the transmission power of sound decreased, and thus, a slight sensing error occurred when compared to the impact-absorbing shooting pad having the thickness of 3 mm.

In the impact-absorbing shooting pad having the thickness of 5 mm, 798 bullets were accommodated in the tray. This seems to be due to an increased thickness and an increased repulsive force. In addition, the transmission power of sound decreased, a large sensing error occurred due to a sensitivity of the sound sensor, the reliability of a hit point was reduced, and thus, the sensitivity of the sound sensor should be adjusted to be sensitive. As the sensitivity of the sensor becomes more sensitive, the sensor may respond to external noise, thereby relatively reducing the accuracy of sensing. However, due to a large thickness, no bullet marks remained on the surface.

Accordingly, it is preferable that the impact-absorbing shooting pad has a thickness of 3 to 4 mm, and it is more preferable that the impact-absorbing shooting pad has a thickness of 3 mm.

Also, the impact-absorbing shooting pad 120 is in close contact with the frame 110 to form an enclosed space between the display device D, the impact-absorbing shooting pad 120, and the frame 110. In the present disclosure, the enclosed space formed through the impact-absorbing shooting pad 120 functions as a medium for transmitting impact/ sound generated when the impact-absorbing shooting pad 120 is hit. Although a position where a shooting pad is hit is directly sensed without an enclosed space in the related art, because a sensing unit should directly contact the shooting pad to this end, the sensing unit may be damaged by impact caused by frequent strikes, thereby degrading the precision of sensing.

The bullet dispersion prevention unit 130 is coupled to each of both side surfaces of the frame 110 or the case 140, and is configured to, when a bullet hits the impact-absorbing shooting pad 120 at an angle exceeding the preset angle range from the vertical and forms an angle of reflection to a side without falling downward, prevent the bullet from being scattered outward. The bullet dispersion prevention unit 130 includes a fixing portion 131 and a bullet guiding portion 132.

The fixing portion 131 has a plate shape, is coupled through a magnet 1311 along a side surface of the frame 110 or the case 140, and supports the bullet guide portion 132 so that the bullet guide portion 132 protrudes beyond the impact-absorbing shooting pad 120.

The bullet guide portion 132 may be integrally formed with the fixing portion 132 that protrudes forward beyond a surface of the impact-absorbing shooting pad 120, to surround inward each of both side surfaces of the impact-absorbing shooting pad 120. A plurality of bullet guide portions 132 may be bent as shown in (*a*) of FIG. 4, or more preferably, may be formed in an inward spiral shape as shown in (*b*) of FIG. 4 so that bullets are repeatedly reflected and hit inside a plurality of bent portions and fall downward without being scattered outward.

As such, because the bullet dispersion prevention unit 130 guides bullets to fall downward without being scattered to various positions of a shooting range through the bullet guide portion 132, the bullets may be efficiently collected, and may be reused immediately without needing to clean to collect the bullets, thereby reducing maintenance costs. Also, because bullets hitting the shooting panel may be prevented from being reflected and hitting other users, safety accidents may be prevented.

The case 140 is located at the rear of the frame 110 to be located on a rear surface of the display device D, and protects the controller 180 provided on the rear surface of the display device D. The case 140 may have a plurality of holes through which heat generated by the display device D and the controller 180 may be dissipated.

Although not shown, a speaker may be provided in the case 140. The case 140 may have the tray 112 coupled to a bottom surface thereof to mount the present disclosure in a stand shape, and wheels for facilitating movement may be provided on a bottom surface of the mount.

The protective transparent pad 150 is in close contact with a surface of the display device D, and a circumferential surface of the protective transparent pad 150 is coupled to the inner circumferential surface of the frame 110, so that when the impact-absorbing shooting pad 120 is torn and a bullet goes through the impact-absorbing shooting pad 120, the protective transparent pad protects the display device D. The protective transparent pad 150 may be a polycarbonate transparent plate, and may be preferably formed to be transparent to show an image displayed on the display device D, like the impact-absorbing shooting pad 120.

In this case, the protective transparent pad 160 may be completely closely attached to the circumferential surface of the frame 110 through a fitting groove structure, and an enclosed space is formed between the protective transparent pad 150 and the impact-absorbing shooting pad 120 located on the front surface.

A plurality of panel fixing members 151 may be provided along a circumferential direction of the frame 110 between the impact-absorbing shooting pad 120 and the protective transparent pad 150. The plurality of panel fixing members 151 may be arranged in the circumferential direction of the frame 110, and may maintain a constant distance between the impact-absorbing shooting pad 120 and the protective transparent pad 150 respectively located on the front surface and a rear surface of the frame 110. Accordingly, the impact-absorbing shooting pad 120 may be prevented from being moved along a shooting direction even by hitting or vibration, thereby providing a constant sensing value.

At least one sound sensor 160 is located along the inner circumferential surface of the frame 110 including the enclosed space, and detects a sound wave signal of vibration/impact formed when a bullet hits the impact-absorbing shooting pad 120 and senses a hit position of the impact-absorbing shooting pad 120 based on the sound wave signal.

In this case, a plurality of sound sensors 160 are arranged in the circumferential direction of the frame 110, and preferably, are located at respective corners of the frame 110. In the related art, a sensor is located to directly contact a surface of a shooting panel in order to detect a hit position. Because the sensor used in this case is a sensor for detecting the amount of impact, that is, the amount of vibration due to impact, and uses the shooting panel as a medium, an error may occur in a detected position according to a state of the shooting panel.

However, the sound sensor 160 of the present disclosure detects an impact sound generated when the impact-absorbing shooting pad 120 is hit. Because distortion of sound may be prevented and an error may be significantly reduced through a sealing structure formed by the impact-absorbing shooting pad 120 and the protective transparent pad 150 respectively coupled to the front surface and the rear surface of the frame 110, a magnitude of a sensed sound wave is filtered and a length of a filtered signal from each of the plurality of sensors is calculated proportionally to a distance and a more accurate score is calculated by tracking a position corresponding to the impact-absorbing shooting pad 120. Accordingly, when compared to a detection method through a vibration sensor attached to a shooting panel formed as a single plate in the related art, a detection error may be significantly reduced and an accurate target position may be detected.

At least one temperature sensor 170 may be arranged in the inner circumferential direction of the frame 110, and may be located on an inner upper end of the frame 110. Because the temperature sensor 170 measures an ambient temperature inside the sealing structure, only one temperature sensor 170 is sufficient. The impact-absorbing shooting pad 120 is formed of a soft material and may cause an error of a hit point due to a temperature change. The temperature sensor 170 may sense a temperature inside the sealing structure and may correct a hit position to make the hit position accurate.

The controller 180 may collect, record, and rank data of at least one of the number of fired bullets, a hit rate of a part where a bullet hits the shooting panel, and a user's response to a firing signal. In addition, the controller 180 may provide to a user terminal M through wireless communication, through a wireless communication module 141, data information of at least one of the number of fired bullets, a hit rate of a part where a bullet hits the shooting panel, and a user's response to a firing signal. Accordingly, even when a shooting range is far and it is difficult to obtain text information, game information may be more easily obtained through the user terminal M.

Also, the controller 180 filters a magnitude of a sound wave sensed by each of the plurality of sound sensors 160 when a bullet hits the impact-absorbing shooting pad 120 located on the front surface and proportionally calculates a length of a filtered signal from each of the plurality of sensors according to a distance, and calculates a score by tracking a position corresponding to the impact-absorbing shooting pad 110, thereby more precisely measuring a hit position of the bullet.

In addition, the controller 180 may apply a correction value when calculating coordinates of a hit position by applying a temperature value sensed by the temperature sensor, thereby more accurately calculating a hit position.

Figure 6:
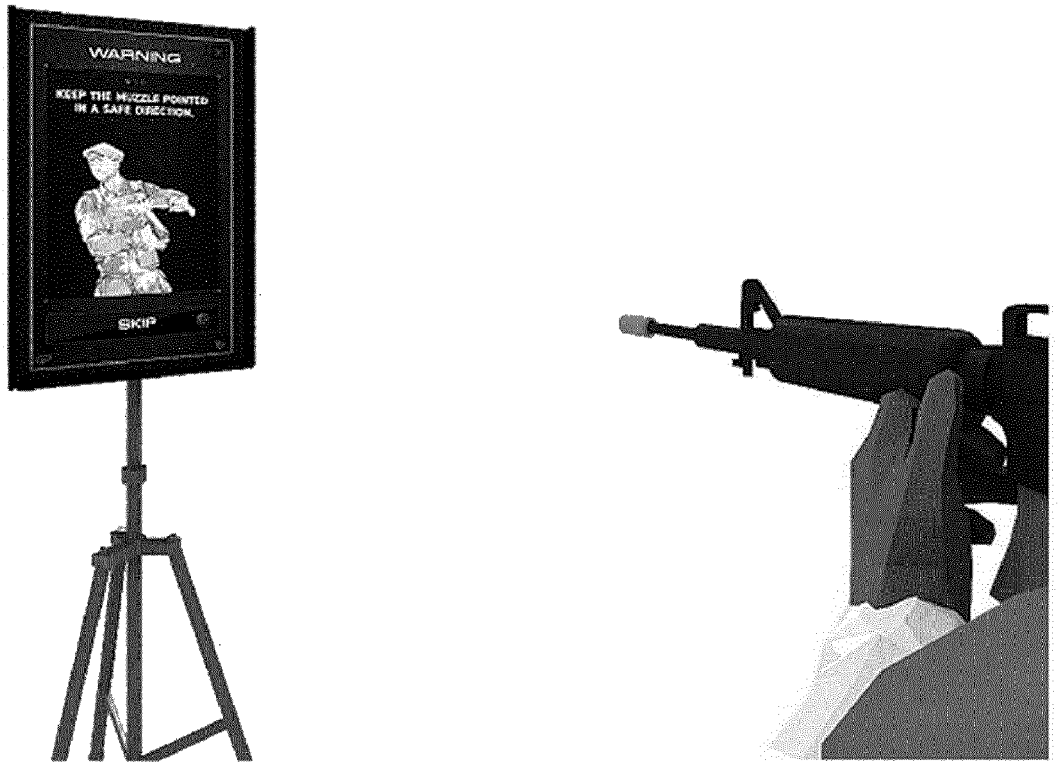
FIG. 6 is a conceptual view illustrating a shooting game through a monitor device having a bullet dispersion prevention function for a shooting game according to an embodiment of the present disclosure.

Also, the present disclosure may be connected through a tripod as shown in FIG. 6, or may be located on a wall surface, but a coupling position is not limited thereto.

Also, although not shown in the present disclosure, a webcam may be installed on an upper end of the frame. Accordingly, an image of the other party who is shooting may be provided. The present disclosure may be connected to a server through network communication and a ranking service may be provided through online competition.

The embodiments of the disclosure disclosed in the present specification and drawings have been provided to easily describe the present disclosure and to help with the understanding of the present disclosure, and are not intended to limit the scope of the present disclosure. That is, it is obvious to one of ordinary skill in the art that various modifications may be made based on the technical spirit of the present disclosure.

What is claimed is:

1. A monitor device coupled to a display device comprising:

a frame coupled along a circumferential surface of the display apparatus and protruding out of a front surface of the display device;

an impact-absorbing shooting pad coupled to an end of the protruding frame, formed to be transparent to show an image displayed on the display device, and configured to, when a bullet hits a hitting surface at an angle within a preset angle range from the vertical, absorb impact of the bullet so that the bullet hitting the hitting surface does not go through the impact-absorbing shooting pad and falls downward; and a bullet dispersion prevention unit configured to, when a bullet hits the impact-absorbing shooting pad at an angle exceeding the preset angle range from the vertical, enable the bullet bounced from the impact-absorbing shooting pad to fall downward without being scattered outward.

2. The monitor device coupled to the display device according to claim 1, further comprising:

a case coupled to a rear end of the frame and protecting a controller located on a rear surface of the display device; and a protective transparent pad being in close contact with a circumferential surface of the frame and a surface of the display device to form a space between the protective transparent pad and the impact-absorbing shooting pad, and configured to, when the impact-absorbing shooting pad is torn and the bullet goes through the impact-absorbing shooting pad, protect the display device.

3. The monitor device coupled to the display device according to claim 2, wherein the bullet dispersion prevention unit is coupled to each of both side surfaces of the frame or the case and protrudes forward beyond a surface of the impact-absorbing shooting pad to surround the impact-absorbing shooting pad.

4. The monitor device coupled to the display device according to claim 3, wherein the bullet dispersion prevention unit comprises a magnet on a side surface and is attached to both side surfaces of the frame or the case.

5. The monitor coupled to the display device according to claim 2, wherein the controller is configured to wirelessly communicate with a mock gun that fires a bullet, and collect, record, and rank data of at least one of a number of fired bullets, a hit rate of a part where a bullet hits the impact-absorbing shooting pad, and a user's response to a firing signal.

* * * * *